US005407304A

United States Patent [19]

Glass et al.

[11] Patent Number: 5,407,304

[45] Date of Patent: Apr. 18, 1995

[54] METHOD AND APPARATUS FOR CONNECTING METAL PILES

[76] Inventors: James O. Glass; Sam M. Glass, both of Rte. 2, Box 32, Anahuac, Tex. 77514

[21] Appl. No.: 64,870

[22] Filed: May 20, 1993

[51] Int. Cl.[6] ..... E02D 13/04

[52] U.S. Cl. ..... 405/279; 405/232

[58] Field of Search ..... 405/232, 274, 276, 277, 405/278, 279, 281

[56] References Cited

U.S. PATENT DOCUMENTS

| | | | |
|---|---|---|---|
| 2,074,906 | 3/1937 | Hausler . | |
| 2,122,835 | 7/1938 | Deros . | |
| 2,161,482 | 6/1939 | Miller et al. . | |
| 2,355,102 | 8/1944 | Odman . | |
| 2,583,928 | 1/1952 | Caudill . | |
| 2,968,931 | 1/1961 | McGrath . | |
| 3,101,956 | 8/1963 | Muller . | |
| 4,028,901 | 6/1977 | Barber . | |
| 4,083,192 | 4/1978 | Diekman | 405/281 |
| 4,124,987 | 11/1978 | Hallman et al. | 405/276 |
| 4,189,256 | 2/1980 | Dawson . | |
| 4,419,030 | 12/1983 | Burkemper | 405/274 X |
| 4,557,630 | 12/1985 | Neil . | |

*Primary Examiner*—Randolph A. Reese
*Assistant Examiner*—John A. Ricci
*Attorney, Agent, or Firm*—Bush, Moseley, Riddle & Jackson

[57] ABSTRACT

Apparatus for threading together adjacent steel piles (10, 12) having male and female interlocking edges (10E, 12E). A threading device (14) is removably supported on a separate wheeled frame or dolly (16) mounted for movement along a pair of parallel horizontal beams (18) secured to opposed sides of the driven pile (10). The threading device (14) has a pile supporting slide (36) supporting the undriven pile (12) between a pair of clamping plates (48). The undriven pile (12) together with the slide (36) is moved laterally a predetermined amount upon clearance of the upper end (10C) of the driven pile (10) with the lower end (12F) of the undriven pile (12) by a lever (64) connected to a rope (61) pulled by a workman on the ground.

13 Claims, 9 Drawing Sheets

METHOD AND APPARATUS FOR CONNECTING METAL PILES

FIELD OF THE INVENTION

This invention relates to a method and apparatus for connecting metal piles to each other in side by side relation, and more particularly to such a method and apparatus for interlocking adjacent edges of undriven metal piles and previous driven metal piles.

BACKGROUND OF THE INVENTION

Sheet metal piles are normally interlocked to each other in side by side vertical relation to prevent adjoining piles from being separated. Adjoining side edges of sheet metal piles have interlocking male and female edges, such as tongue and groove joints, that are first vertically aligned and registered. Vertical alignment of the interlocking edges is accomplished by raising the undriven pile to a height above the previously driven pile and then moving the lower end of the undriven pile laterally until the adjacent edges are vertically aligned. Then, the interlocking portion of the undriven pile is threaded or stabbed within the subjacent interlocking portion of the driven interfitting pile by lowering of the undriven pile. In this position, the undriven pile is driven to the desired depth in the supporting surface while interlocked with the adjacent driven pile.

A problem exists in the vertical alignment or registering of the interfitting side edges for threading as the raised piles have to be moved laterally and a workman below the raised pile cannot manually contact and move the raised pile laterally for alignment. One method employed heretofore has been to position a workman on the upper ends of the driven piles for manually positioning the raised pile. However, such a method is unsafe particularly in the event of high wind conditions.

As shown in U.S. Pat. No. 4,189,256 dated Feb. 19, 1990, one method has been utilized heretofore to permit a vertical alignment of aligned interlocking side edges of adjacent piles without having a workman positioned on the upper ends of the driven piles. Such a method has utilized a mechanical guiding or threading device which is connected to an open side flange of the driven pile for vertical movement along the side flange while supporting the unsecured pile thereon. The mechanical guiding device has rollers engaging opposed surfaces of the driven pile and is attached to the driven pile by a workman on a lower supporting surface below the upper end of the driven pile. To move the unsecured pile laterally for alignment, spring urged plungers after attachment of the device to the driven pile are cocked and released prior to the upward vertical movement of the mechanical threading device and undriven pile along the driven pile. The spring urged plungers continuously urge a support on the threading device for the unsecured pile laterally. The mechanical threading device and the unsecured pile are lifted vertically by an overhead crane engaging the upper end of the unsecured pile and when the lower end of the unsecured pile clears the upper end of the adjacent driven pile, the unsecured pile is moved laterally automatically by the spring operated plungers to align the interfitting side edges vertically. Then, the unsecured pile and mechanical threading device are lowered with the interfitting side edges being threaded and remaining in interlocked position. Upon removal of the mechanical device, the unsecured pile is then driven by a pile driver to the predetermined depth in the supporting surface. Such a mechanical device is sold by the L. B. Foster Company, Pittsburgh, Pa. as a Dawson sheet pile threader.

However, in practice, it has been found that the automatic shifting or movement of the lower end of the raised pile laterally into vertical alignment with the driven pile does not always function properly and a workman oftentimes has to be positioned on the upper ends of the driven piles in order to obtain the accurate vertical alignment required for threading and registering of the interlocking side edges. Particularly after substantial use of the mechanical device, the plunger springs may lose part of their resilience and rust often occurs between moving parts of the mechanical device. Also, the size, length, and weight of various piles vary substantially and it is common to utilize only a single size of pile threader for the various types of piles.

U.S. Pat. No. 2,583,928 dated Jan. 29, 1952, shows a steel sheet pile threader in which the lower end of a raised pile is shifted laterally by pulling of a lanyard by a workman below the pile for effecting a camming of the lower end of the raised pile in a lateral position for vertical alignment with the driven pile. Rollers on the threader engage opposed sides of the driven pile for guiding the vertical movement of the pile being raised. The rollers are moved toward and away from the driven pile by the rotation of bolts connecting the rollers. The positioning or securement of the threader onto the driven pile for vertical movement along the driven pile and the subsequent positioning of the undriven pile in supporting relation on the threader is oftentimes time consuming as accurate positioning is required. Also, a safety hazard is presented to workman in the positioning and operation of the threader.

SUMMARY OF THE INVENTION

The present invention is directed to a method and apparatus for connecting metal piles to each other in side by side interlocked relation, and particularly to such an apparatus and method for vertically aligning a side edge on a raised undriven pile with a subjacent interfitting side edge of a driven pile for threading or stabbing the interfitting side edges upon subsequent lowering of the raised pile.

The present invention is directly particularly to such apparatus which includes a threading device supported on a separate dolly for rolling movement along parallel horizontal beams toward and away from the driven pile. The dolly has lower support guide rollers mounted on and riding along the spaced parallel beams mounted on opposed sides of the driven pile and extending outwardly therefrom. In this manner, the threader is not required to be lifted when attached or removed from the driven pile. Rollers engage opposed sides of the driven pile for riding along the driven pile in a vertical direction for guiding the pile being raised vertically. It is desirable that the rollers be moved into and out of engaged relation in a simple efficient manner and a hand operated screw is provided for manual actuation to move the rollers into and out of engaged position.

The threader or threading device with the rollers in an open position is moved by the dolly to a position where the rollers are accurately positioned, and then the rollers are moved into engaged relation with the driven pile. Then, the undriven pile is secured by clamping onto a supporting slide on the threader in a closely spaced relation to the driven pile. The undriven pile and threader are then lifted by an overhead crane from the dolly to a position above the upper end of the driven pile. Then, a workman from a lower supporting surface, such as the ground, pulls a flexible cable or rope connected to a lever on the vehicle to move laterally the supporting slide and undriven pile into vertical alignment with the subjacent driven pile for threading or stabbing of the interlocking edges upon subsequent lowering of the undriven pile by the overhead crane. The threader along with the raised pile are lowered with the threader contacting the supporting dolly where it is released from the driven pile and moved laterally by the dolly for another sequence. The undriven pile is then lowered by the overhead crane onto the supporting surface and driven by a pile driver to a predetermined depth while in interlocked position with the adjacent driven pile.

The present invention thus permits a workman to easily move a threader laterally without lifting of the threader and repositioning. Also the workman at a safe location below the raised undriven pile can easily move the undriven pile in a lateral direction by moving a slide supporting the undriven pile thereby to provide vertical alignment of the interfitting side edges of the adjacent piles. The workman simply pulls on a flexible cable or rope to move the slide and undriven pile supported thereon. Such an arrangement has been found to be a highly accurate and effective means for vertically aligning interlocking edges of a pair of adjacent metal piles and then lowering the upper pile into a stabbed interlocking relation with the lower driven pile.

It is an object of the present invention to provide a method and apparatus for stabbing or threading interfitting male and female edges of adjacent metal piles which overcome the difficulties heretofore in vertically aligning the interlocking edges prior to threading or stabbing.

It is a further object of this invention to provide such a method and apparatus in which the raised undriven pile is moved laterally into vertically aligned position with a driven pile by manual operation of the apparatus by a workman positioned below the raised sheet metal pile on a lower supporting surface.

A further object is to provide a dolly or wheeled support to support the threader for movement toward and away from the driven pile for attachment and release from the driven pile.

An additional object is to provide such a threader having rollers engaging opposed sides of the driven pile with a manually actuated screw for effecting movement of the rollers into and out of engagement with the driven pile.

Other objects, features, and advantages of this invention will become more apparent after referring to the following specification and drawings.

DESCRIPTION OF THE INVENTION

Figure 1:
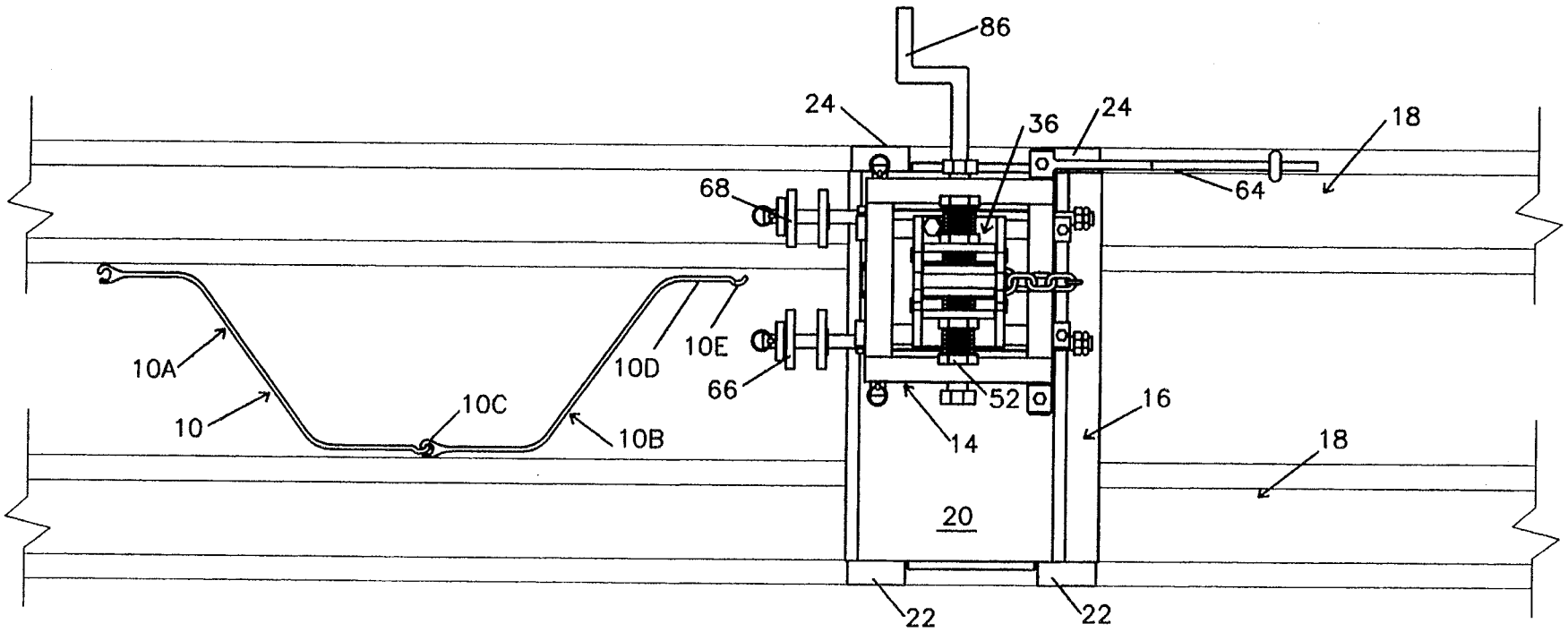
FIG. 1 is a top plan of the apparatus comprising the present invention showing a pile threader mounted on a dolly for movement along a pair of steel beams mounted on opposed sides of a driven pile with the rollers of the threader in an open position.

As well known, sheet metal piles are driven by a pile driver at a construction site into the ground or the bottom of a body of water, such as a stream or bay, for example. The sheet metal piles normally are of a channel or Z-shape in cross section and adjacent piles are interlocked to prevent separation of the driven piles thereby to provide a continuous wall. Adjacent side edges of adjacent piles interfit in an interlocking relation and the undriven raised pile must be vertically aligned with the adjacent driven pile for subsequent threading or stabbing to form the interlocking relation.

Referring now to the drawings for a better understanding of the invention, and more particularly to FIGS. 1–4, a previously driven pile is illustrated generally at 10. Pile 10 is illustrated as a pair of Z-shaped pile sections 10A and 10B which have been previously connected at 10C at a tongue and groove connection. A side flange 10D of pile 10 has a side edge defining a tongue 10E. It is desired that an undriven pile illustrated generally at 12 and including a pair of Z-shaped pile sections 12A and 12B previously secured to each other along joint 12C be interlocked with side edge or tongue 10E. Undriven pile 12 has a side flange 12D and the adjacent side edge defines a groove 12E adapted to receive tongue 10E therein when groove 12E is aligned vertically with tongue 10E and then lowered into an interlocking relation. Tongue 10E and groove 12E define male and female interlocking edges. For this purpose it is necessary to raise the undriven pile 12 by an overhead crane (not shown) until the lower end 12F of pile 12 clears the upper end 10F of driven pile 10. Then, pile 12 is shifted or moved laterally a predetermined distance until groove 12E is in vertical alignment with tongue 10E. In this position pile 12 may be lowered to provide an interlocking of tongue 10E and groove 12E. While Z-shaped piles have been illustrated in the drawings, it is to be understood that this invention may be utilized with various pile sections which utilize interlocking edges.

The present invention is directed to the apparatus and method for guiding pile 12 alongside driven pile 10 in a precise spaced relation thereto when pile 12 is lifted and for shifting pile 12 laterally when the lower end 12F of pile 12 clears the upper end 10F of driven pile 10 for vertically aligning groove 12E over tongue 10E for interlocking upon lowering of pile 12. The apparatus includes a threader or threading device generally indicated at 14 removably supported on a wheeled frame or dolly included generally at 16 for movement along a pair of spaced steel beams 18 which are secured to opposed sides of driven piles 10.

Figure 11:
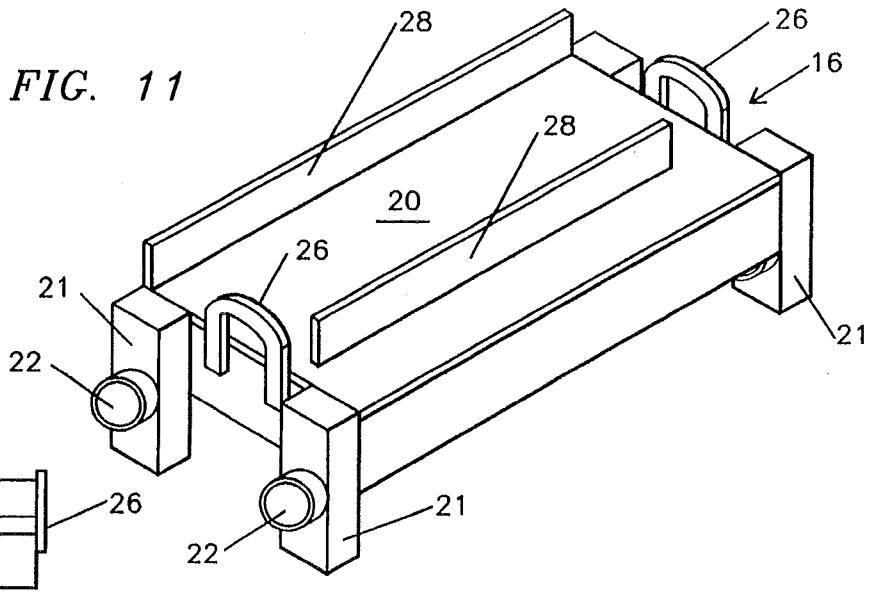
FIG. 11 is a perspective of the supporting dolly on which the threader is removably mounted for lateral movement.
Figure 13:
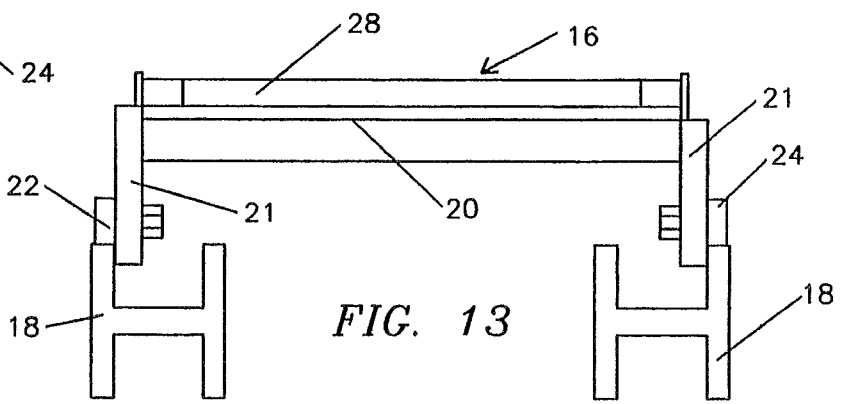
FIG. 13 is a front elevation of the dolly similar to FIG. 11 but showing the dolly supported on a pair of parallel steel beams for movement.
Figure 12:
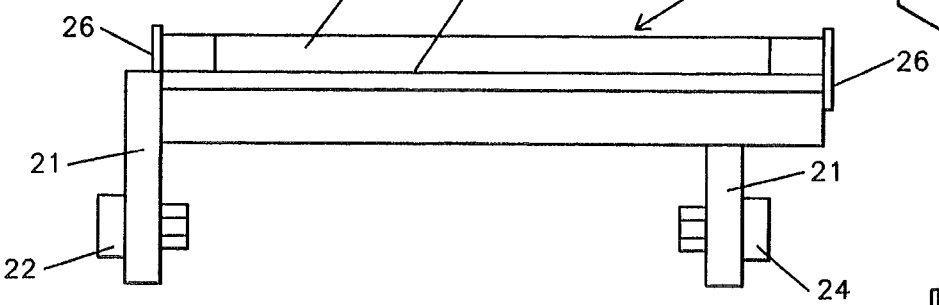
FIG. 12 is a front elevation of the dolly shown in FIG. 11.

As shown in FIGS. 11–13, dolly 16 has a base 20 with vertical legs 21 supporting pairs of rollers 22 and 24 on opposed ends thereof. Hangers 26 on opposed ends of base 20 may be used for lifting of dolly 16. Vertical extensions or bars 28 extend upwardly from base to aid in positioning threading device 14 accurately thereon. As shown in FIG. 13, beams 18 comprise metal H-beams and the lower ends of vertical legs 21 extend downwardly alongside the supporting flanges of beams 18 to restrict lateral movement of dolly 16 when moving along beams 18.

Figure 4:
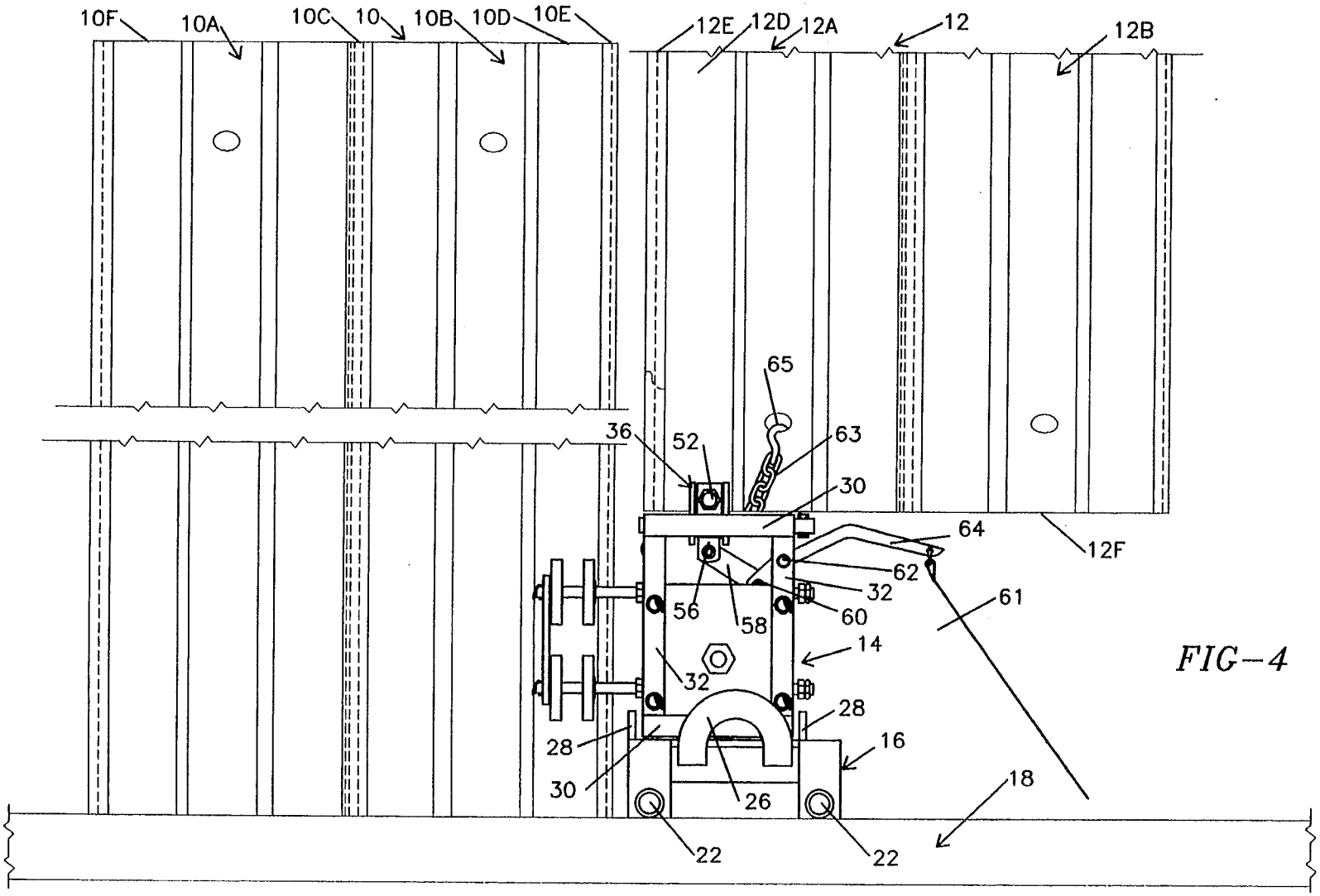
FIG. 4 is a side elevation of the threader as shown in FIG. 3 and mounted on a dolly with the undriven pile supported on the threader and adapted to be lifted vertically with the threader by an overhead crane along the edge of the driven pile.
Figure 6:
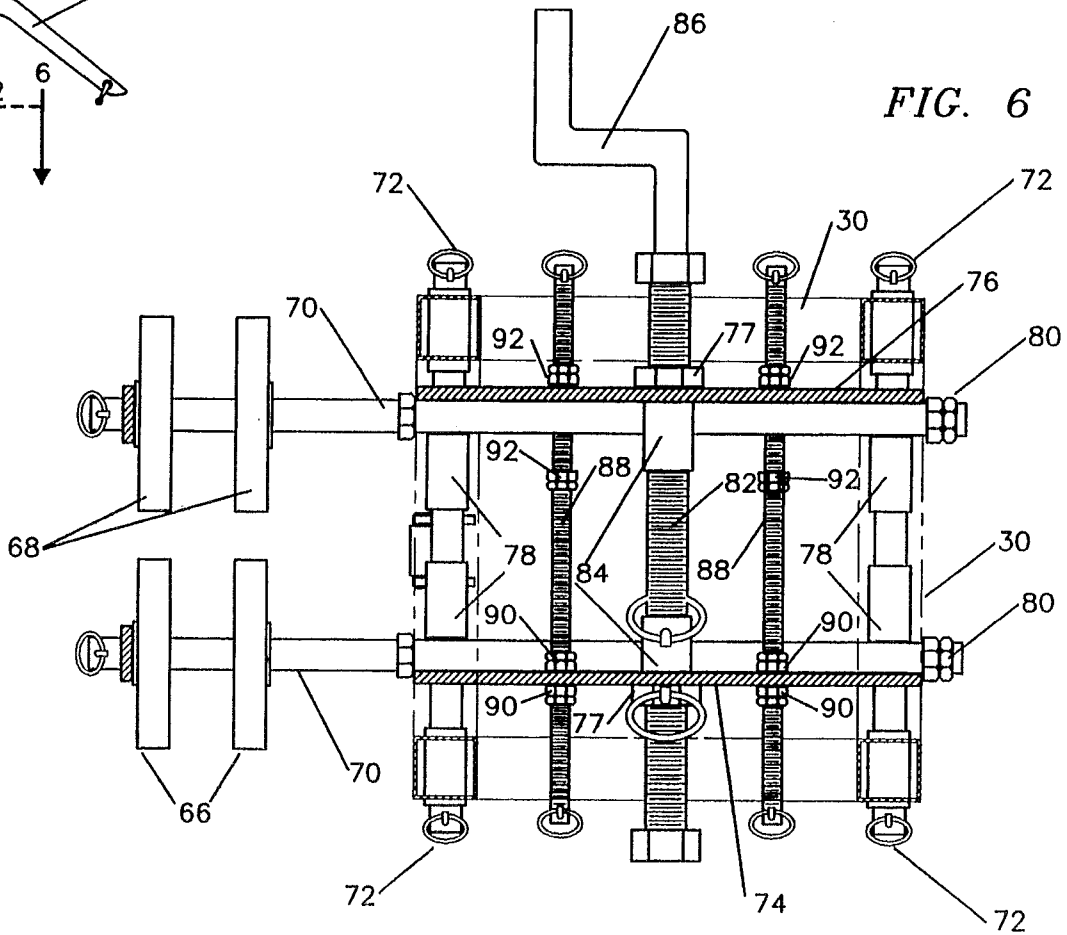
FIG. 6 is a section taken generally along line 6—6 of FIG. 5 and showing the means for effecting movement of the rollers into and out of engagement with the driven pile.
Figure 5:
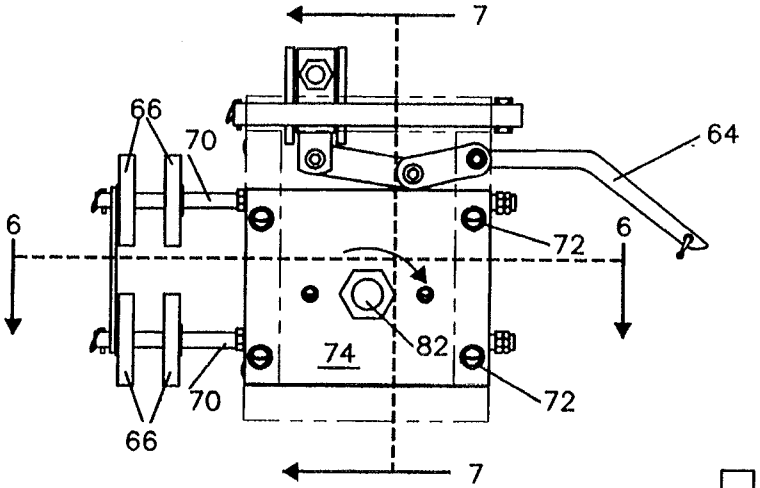
FIG. 5 is a side elevation of the threader shown removed from the pile.

Threading and guiding device 14 as shown in FIG. 4 is adapted to fit between vertical members 28 on supporting base 20 of dolly 16 thereby to be easily moved with dolly 16. Threading device 14 comprises a box-type frame having connected horizontal and vertical frame members 30 and 32. A pair of parallel rods 34 extend between upper horizontal frame members 30. Mounted on rods 34 for sliding movement as shown particularly in FIG. 5 is a pile support slide generally indicated at 36 including lower tubular members 38 receiving rods 34 and a base 40 secured between tubular members 38. Side members or plates 42 extend upwardly from base 40 and have vertical slots 44 thereon. End plates 46 between side plates 42 extend upwardly from base 40. Mounted on end plates 46 for relatively adjustable movement are gripping plates 48. Externally threaded screws 50 are secured to gripping plates 48 and hexagonal ends 52 may be engaged by a suitable wrench or the like for adjustment of plates 48. Locking nuts 54 retain screws 50 in position after adjustment. For a specific pile thickness, one of the adjustable plates 48 may be fixed and locked in position by lock nut 54 with the other plate 48 being moved into and out of gripping and clamping relation with a pile positioned on base 40 between plates 48. Upper and lower rollers 53 are mounted for rotation on arms 55 secured to frame members 30 and are adapted to contact the edge of the driven pile 10 if needed.

A lower leg 56 extends downwardly from slide 36 and connecting links 58, 60 extend between leg 56 and a shaft 62. Link 60 is secured to shaft 62 for pivotal movement with shaft 62. A lever 64 is secured to an end of shaft 62 for rotation thereof to effect movement of slide 36. A cable or rope 61 is connected to an end of lever 64 for actuation of lever 64 by a workman on the ground or supporting surface beneath pile 12 thereby to move pile 12 laterally as shown particularly in FIG. 14. A chain 63 is connected to slide 36 and a safety hook 65 on an end of chain 63 is received within an opening of pile 12 to retain threading device 14 onto pile 12 if clamping members 48 are inadvertently released from pile 12.

Threading device 14 is adapted for engaging and riding along pile 10 while pile 12 is being raised thereby to guide pile 12 in a vertical direction closely spaced from the adjacent driven pile 10. For this purpose four pairs of rollers 66, 68 are mounted for rotation on axles 70 for engaging opposite sides of driven pile 10. Rollers 66 engage one side of pile 10 and rollers 68 engage an opposite side. Shafts 72 are secured between vertical frame member 32. A pair of movable plates 74, 76 have sleeves 78 mounted on shafts 72 for sliding movement. Bearings 80 secured to plates 74, 76 receive axles 70 for rotation. Thus, rollers 66 are carried by plate 74 and rollers 68 are carried by plate 76. An externally threaded screw 82 is received within sleeves 84 secured to plates 74, 76. Internally threaded nuts 77 are secured to plates 74, 76 and engage screw 82 in threaded relation. Plate 74 and rollers 68 are normally maintained in a fixed relation with plate 76 and associated rollers 66 moving toward and away from plate 74 upon rotation of screw 82. A hand operated crank 86 on the end of externally threaded screw 82 permits a manual rotation of screw 82 to move plate 76 and rollers 66 toward and away from plate 74 and rollers 68. To maintain plate 76 at a predetermined spacing from plate 74, spacer bolts 88 are provided with locking nuts 90 and 92 threaded thereon. Locking nuts 90 are initially secured against plate 74. Upon positioning of plate 76, locking nuts 92 are tightened against plate 76 for maintaining a precise spacing between rollers 66, 68.

Figure 2:
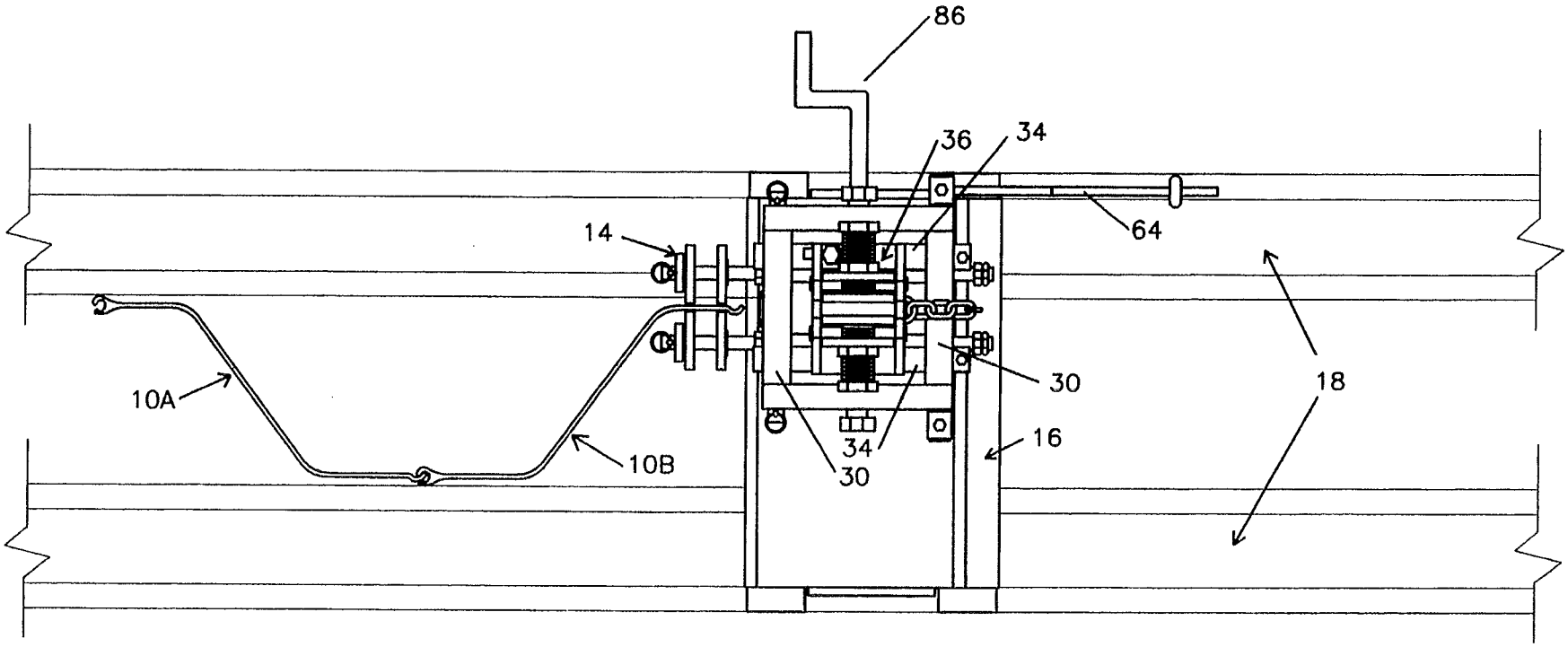
FIG. 2 is a top plan view similar to FIG. 1 but showing the threader with the rollers thereof in a closed position engaging opposed sides of a side flange of the driven pile.
Figure 3:
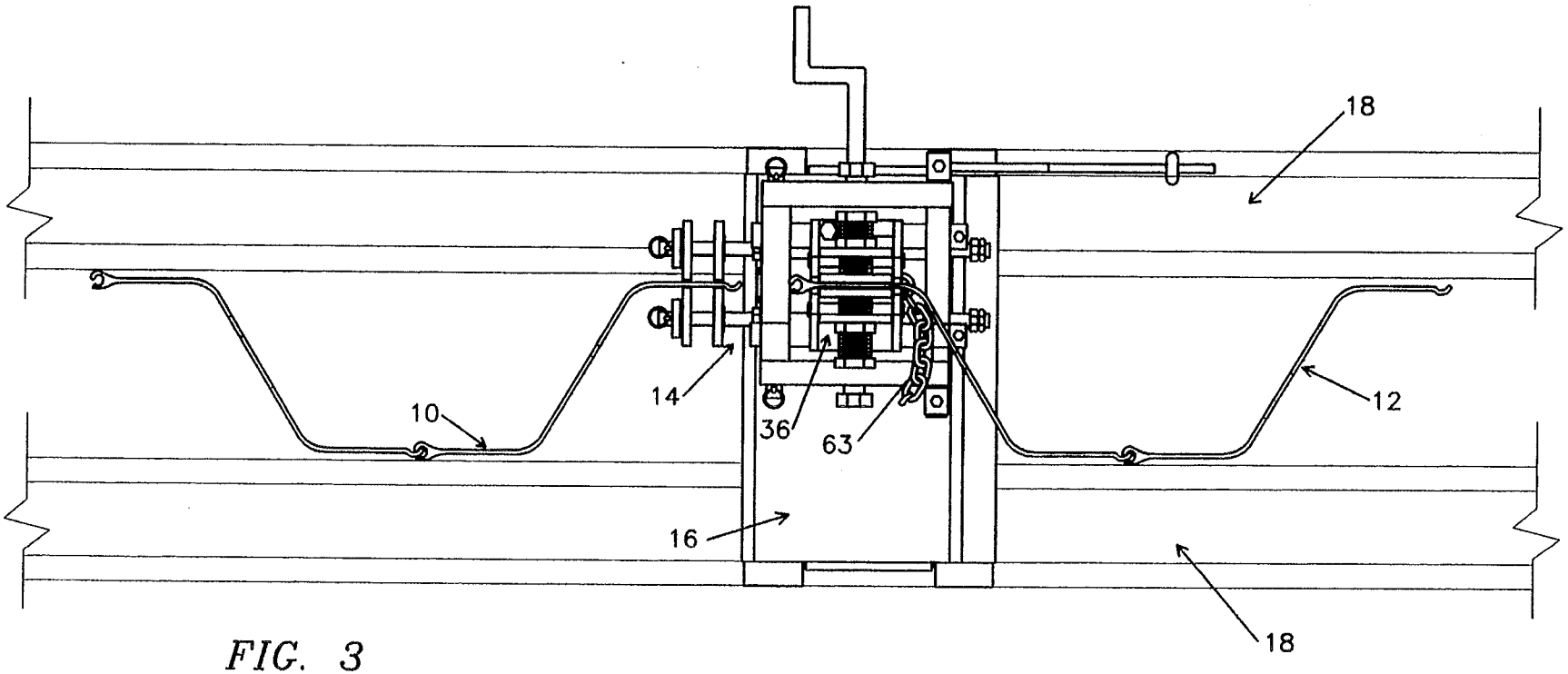
FIG. 3 is a top plan view similar to FIGS. 1 and 2 but showing the undriven pile to be raised gripped in supporting relation by the threader and adapted to the vehicle by an overhead crane or the like lifting the upper end of the unsecured pile.
Figure 8:
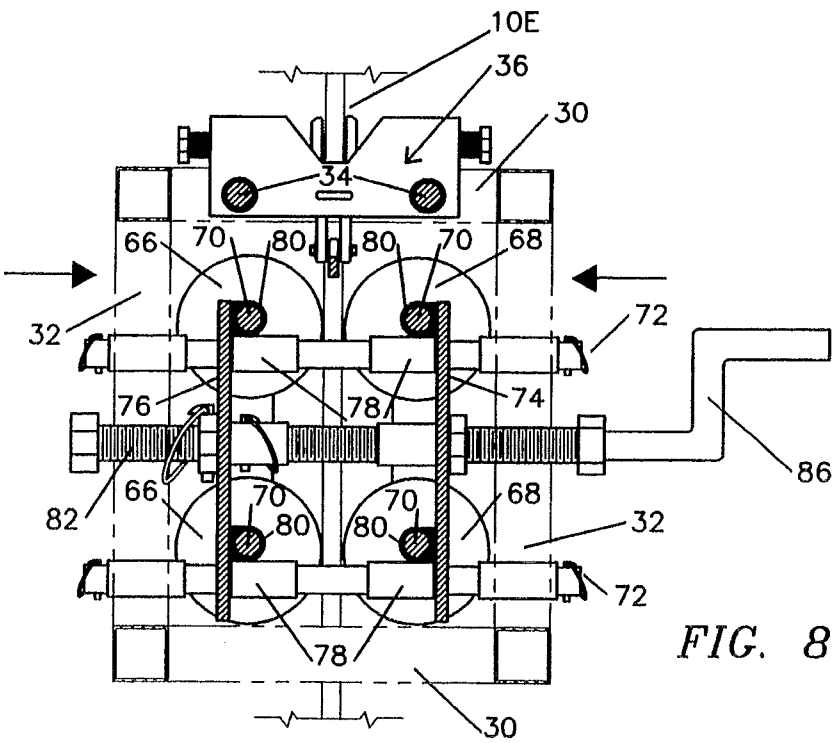
FIG. 8 is a section similar to FIG. 7 but showing the rollers in a closed position engaging the driven pile.
Figure 7:
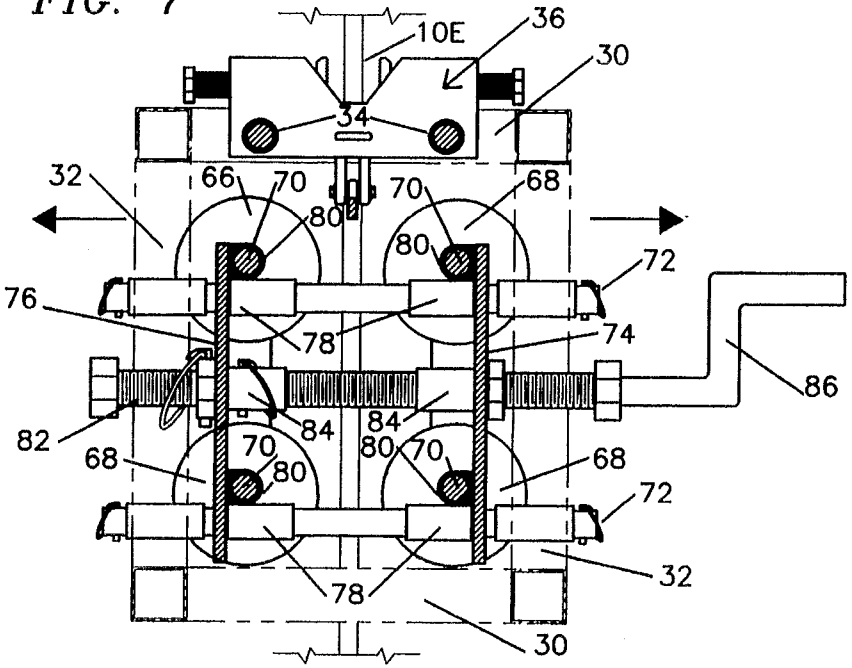
FIG. 7 is a section taken generally along line 7—7 of FIG. 5 and showing the means for effecting movement of the rollers with the rollers in an open position.
Figure 9:
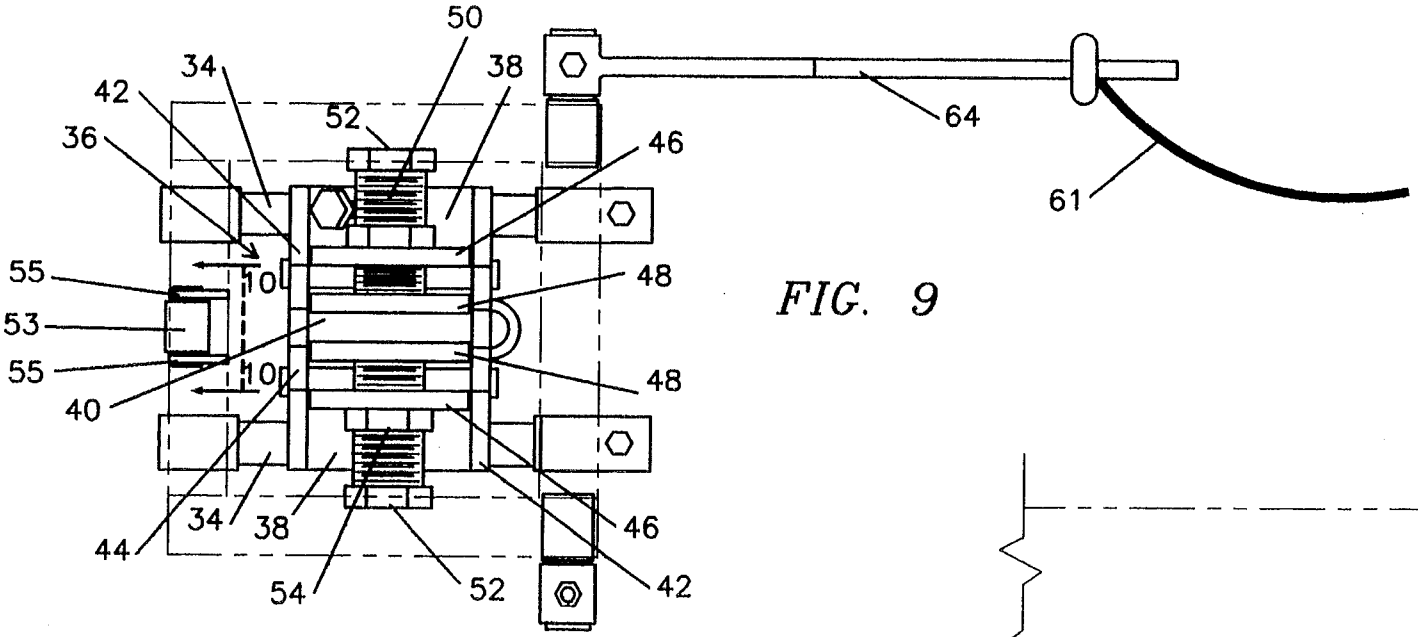
FIG. 9 is an enlarged top plan, partly schematic, of the pile supporting slide on the threader for effecting lateral movement of the undriven pile when raised.
Figure 10:
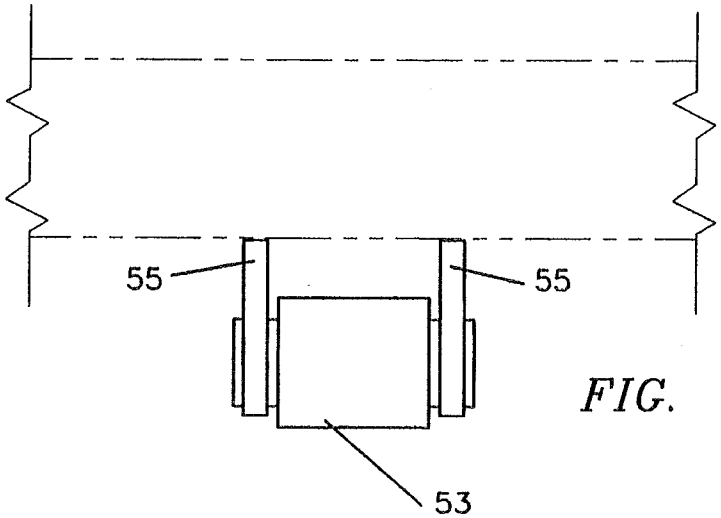
FIG. 10 is taken generally along line 10—10 of FIG. 9 and shows rollers which may engage the adjacent edge of the driven pile.

In operation, as shown in FIG. 1, threading device 14 is positioned on dolly 16 and is manually moved along beams 18 toward engagement with driven pile 10 with rollers 66 and 68 in an open position. Dolly 16 is moved to the position shown in FIG. 2 in which rollers 66, 68 are on opposite sides of flange 10D. In this position, screw 82 is rotated manually by rotation of crank 86 thereby to move rollers 66, 68 into engagement with opposite sides of flange 10D as shown in FIGS. 2 and 8. Next, undriven pile 12 is lowered by an overhead crane (not shown) to the position as shown in FIG. 3 but with clamping plates 48 in an open position as shown in FIG. 9. After positioning of the lower end 12F of pile 12 between clamping plates 48 in supporting position on base 40, a suitable wrench or the like is employed to rotate screw 50 for clamping plates 48 into tight engagement with opposed faces of pile 12. Hook 65 then engages pile 12 at the opening in pile 12 as shown in FIGS. 4 and 12.

Figure 14:
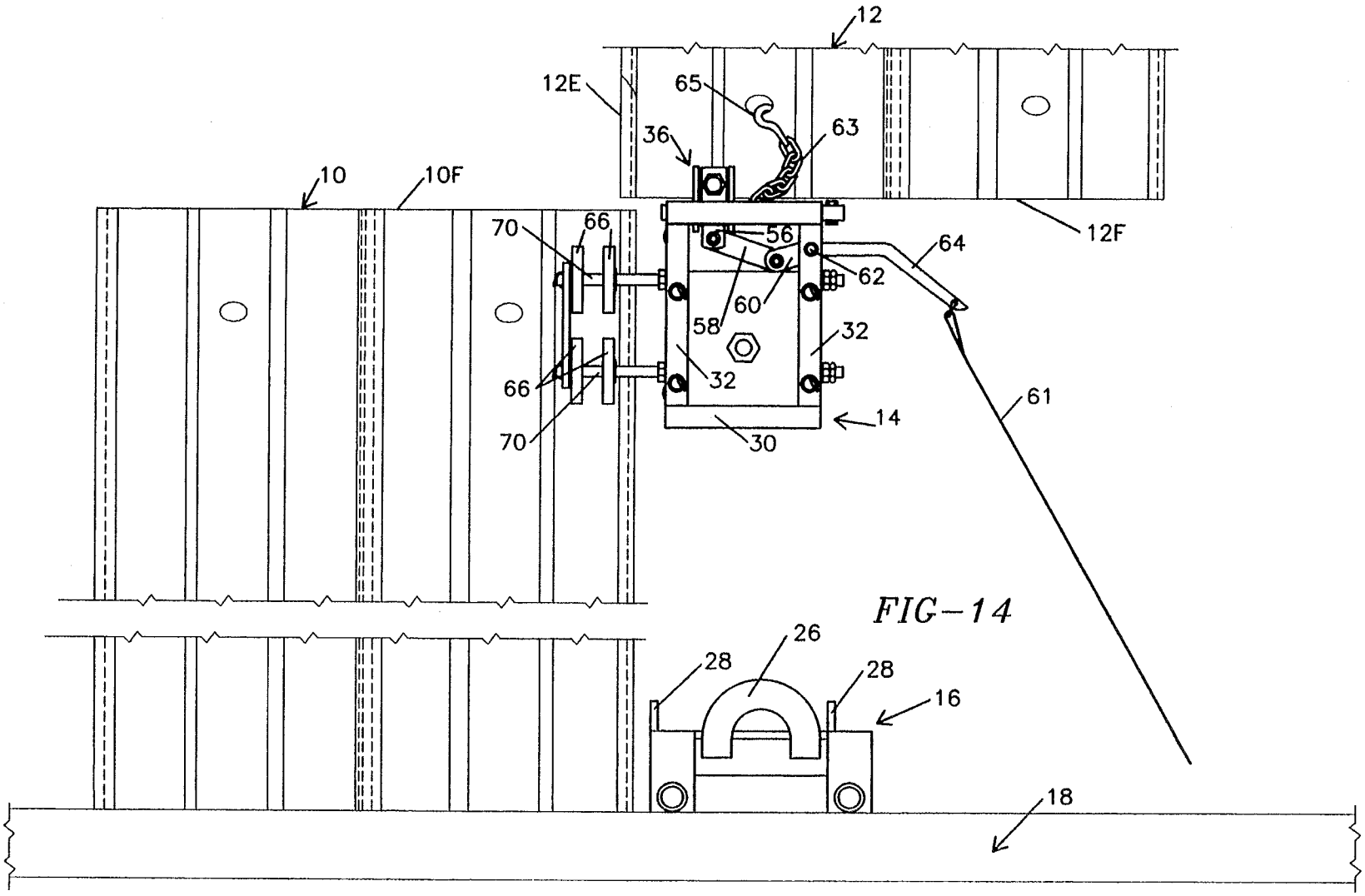
FIG. 14 is a side elevation similar to FIG. 4 but showing the threader and undriven pile raised above the lower dolly with the lower end of the raised pile moved laterally into vertically aligned position by manual actuation of a cable connected to a lever.

Next, pile 12 is lifted by the overhead crane along with threader 14 gripped by clamping plates 48 on pile 12. Rollers 66 and 68 guide the upward vertical movement of threader 14 and undriven pile 12 to a position where the lower end 12F of undriven pile 12 clears the upper end 10F of driven pile 10 as shown in FIG. 14. In this position, a workman pulls on cable 61 to move lever 64 downwardly for rotation of shaft 62 and actuation of links 58, 60 to move slide 36 laterally along with pile 12 with groove 12E in vertical alignment with tongue 10E. It may be desirable to notch or remove a lower end portion of the flange defining groove 12E to facilitate the initial registration of groove 12E and tongue 10E as shown in FIG. 4. If the flange defining groove 12E is notched as shown in FIG. 4, groove 12E and tongue 10E may be interlocked without having lower end 12F above upper end 10F as it is only necessary that the unnotched portion clear upper end 10F. In this position, pile 12 is lowered by the overhead crane along with threader 14 with groove 12E and tongue 10E being in an interlocked position. Pile 12 is lowered until threader 14 is again supported on dolly 16. In this position, crank 86 on screw 82 is rotated to move rollers 66, 68 out of engagement with driven pile 10. Then, plates 48 are removed from gripping engagement with pile 12 by rotation of screws 50. In this position, dolly 16 along with threader 14 may be moved from beneath undriven pile 12 along beams 18 to a remote position. Pile 12 is then lowered onto the supporting surface for subsequent driving into the formation by a suitable pile driver or the like. Then, another sequence may be commenced with a new undriven pile.

While a preferred embodiment of the present invention has been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. A method for threading together male and female interlocking edges of adjacent steel piles comprising the following steps:

providing a pair of generally parallel horizontal beams on opposite sides of a plurality of previously driven metal piles extending outwardly from an interlocking edge of a driven pile;

providing a wheeled support frame for movement along said beams in a direction toward and away from said interlocking edge;

removably mounting a pile threading device onto said wheeled support frame, said threading device having rollers for engaging the driven pile and clamping members for clamping an adjacent undriven pile;

moving said pile threading device and wheeled support frame along said beams to a predetermined position relative to the interlocking edge of the driven pile with the rollers on said threading device positioned adjacent opposed sides of the undriven pile;

moving said rollers into engagement with opposite sides of said driven pile for guiding said threading device in vertical movement along the driven pile;

lowering said undriven pile onto said threading device with the lower end of said undriven pile positioned between said clamping members;

then lifting said undriven pile and threading device from said wheeled support frame to a height at which the lower end of the undriven pile clears the upper end of the driven pile;

then moving said undriven pile laterally until the interlocking edges of said driven pile and undriven pile are in vertical alignment;

next lowering said undriven pile in interlocking relation with said driven pile to a position at which the threading device is supported on said wheeled frame;

then disconnecting said undriven pile from said threading device;

next moving said threading device and said wheeled frame along said beams from beneath said undriven pile; and then driving said undriven pile into the formation while in interlocked position with said driven pile.

2. The method as set forth in claim 1 including the steps of:

providing said threading device with a pile supporting slide mounted for relative lateral movement and having said pile clamping members therein;

providing a manually operated linkage between said slide and said threading device for a predetermined lateral movement of said slide and undriven pile mounted thereon; and actuating said linkage from a position on the ground beneath the undriven pile for lateral movement of the pile supporting slide and undriven pile clamped thereon to the vertically aligned position with said driven pile.

3. A method as set forth in claim 1 including the steps of:

mounting said rollers on said threading device for movement toward and away from each other;

providing a manually operated externally threaded screw operatively connected to said rollers for movement of said rollers; and manually rotating said screw for movement of said rollers toward and away from each other.

4. Apparatus for interlocking male and female side edges of an undriven metal pile and an adjacent previously driven metal pile; said apparatus comprising:

a pair of generally parallel horizontal beams on opposite sides of the previously driven metal pile and extending laterally outwardly from an interlocking edge of the driven pile;

a wheeled support frame mounted on said beams for movement along said beams in a direction toward and away from said interlocking edge;

a pile threading device removably mounted on said wheeled support frame for movement therewith along said beams, said pile threading device having rollers thereon engaging opposite sides of said previously driven pile and clamping members clamping opposed sides of said undriven pile to secure said undriven pile to said threading device; and means on said pile threading device to move said undriven pile laterally a predetermined amount for vertically aligning said male and female side edges of said piles after the lower end of said undriven pile clears the upper end of said driven pile.

5. Apparatus as set forth in claim 4 wherein said pile threading device has a pile supporting slide having said clamping members thereon and mounted for relative sliding movement toward and away from the driven pile; and a manually operated lever is operatively connected to said slide for moving said slide and undriven pile laterally a predetermined distance upon manual actuation of said lever.

6. Apparatus as set forth in claim 4 wherein roller frames support said rollers for movement toward and away from each other; and a manually operated externally threaded screw is operatively connected to said roller frame for movement of said rollers upon manual rotation of said screw.

7. A pile threading device adapted to support an undriven pile thereon and to guide the undriven pile vertically along a driven pile as the undriven pile is lifted along the driven pile, the driven and undriven piles having male and female side edges adapted to be interlocked; said threading device comprising:

a body;

a pile supporting slide mounted on said body for relative sliding movement;

means on said slide to clamp the undriven pile thereon for sliding movement;

a plurality of rollers mounted on said body for movement toward and away from each other;

a pair of roller frames for said rollers supporting said rollers for rotation on opposed sides of said driven pile;

a pair of generally parallel fixed support members mounted on said body and supporting said roller frames for sliding movement;

a manually operated externally threaded screw mounted on said body for rotation; and means between said externally threaded screw and said roller frames for moving said roller frames and rollers toward and away from each other along said fixed support members upon manual rotation of said externally threaded screw.

8. A pile threading device as set forth in claim 7 wherein a manually operated lever is operatively connected to said pile supporting slide for moving said slide and undriven pile thereon laterally upon manual operation of said lever.

9. A pile threading device as set forth in claim 8 wherein a flexible cable is connected adjacent an end of said lever, and said lever is actuated upon manual tensioning of said cable from a position remote from said threading device.

10. A pile threading device adapted to support an undriven pile thereon and to guide the undriven pile vertically along a driven pile as the undriven pile is lifted along the driven pile, the driven and undriven piles having male and female side edges adapted to be interlocked; said threading device comprising:

a body having a plurality of parallel shafts mounted therein;

a pile supporting slide mounted on said body for relative sliding movement;

means on said slide to clamp the undriven pile thereon for sliding movement;

a plurality of rollers mounted on said body for movement toward and away from each other adjacent opposed sides of said driven pile;

roller frames for said rollers supporting said rollers for rotation along said driven pile and having sleeves mounted on said shafts for sliding movement along said shafts;

a manually operated externally threaded screw mounted on said body for rotation; and means operatively connecting said externally threaded screw to said roller frames for sliding movement of said roller frames and associated rollers along said parallel shafts toward and away from each other upon manual rotation of said externally threaded screw.

11. A pile threading device as set forth in claim 10 wherein a crank is provided on an end of said screw for manual actuation of said screw.

12. A pile threading device adapted to support an undriven pile thereon and to guide the undriven pile vertically along a driven pile, the driven and undriven piles having side edges adapted to be interlocked; said threading device comprising:

a supporting body including a plurality of connected frame members;

a pile supporting slide mounted on said body for relative sliding movement in a generally horizontal direction;

means on said slide to clamp the undriven pile thereon for sliding movement in a generally horizontal direction;

a pair of generally parallel roller frames adapted for positioning on opposed sides of the driven pile, each of said roller frames including an upper roller and a lower roller in generally vertical alignment and adapted to contact an adjacent side of the driven pile; and means on said body operatively connected to said roller frames for moving said roller frames and associated rollers toward and away from each other so that said rollers selectively engage said undriven pile on opposite sides thereof, said upper rollers and said lower rollers when in engagement with the opposed sides of said driven pile stabilizing said pile threading device on said driven pile for movement along said driven pile.

13. A pile threading device as set forth in claim 12 wherein a pair of generally parallel fixed support members extending in a generally horizontal direction are secured to frame members of said supporting body, and said roller frames are mounted on said fixed support members for sliding movement toward and away from each other.

* * * * *